US007080518B2

(12) United States Patent
Kim et al.

(10) Patent No.: US 7,080,518 B2
(45) Date of Patent: Jul. 25, 2006

(54) ICE MAKER FOR REFRIGERATOR AND METHOD OF TESTING THE SAME

(75) Inventors: Seong-Ook Kim, Chinju (KR); Ill-Shin Kim, Changwon (KR); Chang-Hwan Seo, Gimhae (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/974,949

(22) Filed: Oct. 28, 2004

(65) Prior Publication Data

US 2005/0056032 A1 Mar. 17, 2005

Related U.S. Application Data

(62) Division of application No. 10/486,514, filed on Feb. 12, 2004, now Pat. No. 6,857,279.

(51) Int. Cl.
*F25C 1/12* (2006.01)

(52) U.S. Cl. ..... 62/73; 62/74; 62/127; 62/129

(58) Field of Classification Search ..... 62/66–74, 62/125–131, 340–356
See application file for complete search history.

(56) References Cited

U.S. PATENT DOCUMENTS

| | | | | |
|---|---|---|---|---|
| 3,946,573 | A | 3/1976 | Nichols et al. | |
| 4,774,814 | A * | 10/1988 | Yingst et al. | 62/126 |
| 5,182,916 | A | 2/1993 | Oike et al. | |
| 5,477,694 | A * | 12/1995 | Black et al. | 62/73 |
| 5,549,042 | A | 8/1996 | Bukoschek et al. | |
| 5,784,891 | A | 7/1998 | Lee | |
| 5,813,238 | A * | 9/1998 | Lee | 62/71 |
| 6,148,620 | A | 11/2000 | Kumagai et al. | |
| 6,467,944 | B1 | 10/2002 | Ugolini | |
| 6,574,974 | B1 | 6/2003 | Herzog et al. | |
| 6,609,387 | B1 | 8/2003 | Sasaki et al. | |
| 6,637,217 | B1 | 10/2003 | Kim et al. | |
| 6,679,073 | B1 | 1/2004 | Hu | |

FOREIGN PATENT DOCUMENTS

| | | |
|---|---|---|
| JP | 2000-041567 | 2/2000 |
| JP | 2000-292042 | 10/2000 |
| KR | 100215073 B1 | 5/1999 |
| KR | 1020000041567 A | 7/2000 |
| KR | 100404463 B1 | 10/2003 |

* cited by examiner

*Primary Examiner*—William E. Tapolcai
(74) *Attorney, Agent, or Firm*—Fleshner & Kim, LLP

(57) ABSTRACT

The present invention relates to an ice maker for a refrigerator and a method of testing the ice maker, and more particularly, to an ice maker for use in a refrigerator for making and releasing ice and a method of testing the ice maker to determine whether the ice maker is normally operated. The present invention provides a process for checking the operation of the ice maker and checks an operating state of all components needed for the normal operation of the ice maker. Further, in the checking process, it is determined whether initial set values needed for the operation of the ice maker are appropriate, and the initial set values can also be adjusted.

22 Claims, 9 Drawing Sheets

ICE MAKER FOR REFRIGERATOR AND METHOD OF TESTING THE SAME

This application is a divisional of U.S. application Ser. No. 10/486,514 filed Feb. 12, 2004, and which has now issued as U.S. Pat. No. 6,857,279 on Feb. 22, 2005. The disclosures of the previous application are incorporated by reference herein.

TECHNICAL FIELD

The present invention relates to an ice maker for a refrigerator and a method of testing the ice maker, and more particularly, to an ice maker for use in a refrigerator for making and releasing ice and a method of testing the ice maker to determine whether the ice maker is normally operated.

BACKGROUND ART

In refrigeration and freezing equipment such as an air-conditioner, a refrigerator and a Kimchi refrigerator, a cooling cycle is performed to generate cold air required for the interior of the equipment. According to the cooling cycle, the cold air is generated by heat exchange between air and a refrigerant flowing along a refrigerant path connecting a compressor, a condenser and an evaporator with one another.

An ice maker is a device for automatically making ice with the cold air supplied by the operation of the above cooling cycle. Accordingly, the ice maker is installed in a predetermined portion of the freezing/refrigeration equipment.

FIGS. 1*a* and 1*b* show the constitution of a conventional ice maker. The conventional ice maker will be described with reference to FIGS. 1*a* and 1*b*.

As shown in the figures, the ice maker is fixed to an inner wall of a freezing chamber by using connecting brackets 2*a*, 2*b* which are formed to extend upwardly from an ice-making container 12. For example, the ice maker is fixed to the wall of the freezing chamber with fastening screws to be tightened through holes which are formed in the connecting brackets 2*a*, 2*b*.

The ice maker is formed with the ice-making container 12 for containing ice-making water and then causing the water to be converted into a predetermined shape of ice. The ice-making container 12 has a cross section in the form of a half moon, and is formed of a material having good thermal conductivity, for example, aluminum. Supply of water to the ice-making container 12 is established through a water supply tube connector 4 provided at one side of the container.

An ice-releasing lever 14 is installed in an upper portion of the ice-making container 12. The ice-releasing lever 14 is constructed such that it can be rotated by a rotational force of a drive motor installed within a casing 20, in order to release ice from the ice-making container when the ice has been completely made in the ice-making container.

As can be seen from FIG. 1*b*, a heater 15 is installed in a lower portion of the ice-making container 12 for applying a small quantity of heat to the ice making container so that the completed ice can be separated from the ice-making container 12. Thus, if the ice making is completed by supplying the cold air into the ice-making container during a predetermined period of time, the heater 15 generates the heat so that the ice frozen to the ice-making container 12 can be detached from the ice-making container 12. The half-moon shaped ice detached as such is separated from the ice-making container 12 by rotation of the ice-releasing lever 14. The ice separated as such drops into an ice storage container (not shown) positioned below the ice-making container. At this time, a plurality of strippers 6 are installed on a front side of a top surface of the ice-making container 12 for preventing the separated ice from coming back into the ice-making container 12.

Before the ice is separated from the ice-making container 12, it is sensed by an ice-detecting lever 16 whether the ice storage container positioned below the ice-making container is filled up with the ice. The ice-detecting lever 16 serves to sense as to whether the ice storage container is filled up with the ice, while moving upward and downward within a predetermined range of angle by means of the motor installed within the casing 20.

The strippers 6 are formed to be a plurality of branches extending rearward from a top portion of a front plate 18 of the ice-making container. The ice-releasing lever 14 is designed to be capable of passing through between the adjacent branches of the strippers 6. The front plate 18 formed at a front face of the ice-making container 12 is shaped to extend downward by a predetermined length from a location at which the ice-making container 12 is positioned. This front plate 18 serves to prevent the ice collected in the ice storage container substantially below the ice-making container from coming into contact with the ice-making container 12.

Here, it has been described above that the ice maker itself is installed within the freezing chamber of the refrigerator. Further, the cold air supplied into the freezing chamber causes the water within the ice-making container 12 to be converted into the ice.

Therefore, if the cold air is supplied in a direction indicated by an arrow within the freezing chamber, it comes in contact with the ice-making container 12 while passing through the rear of the front plate 18. Thus, the ice-making container 12 can be cooled down and ice making is then carried out.

In addition, the heat is generated from the heater 15 during the ice-releasing process. In a case where the heater 15 is normally operated, the heat is first generated during a predetermined period of time. After the predetermined period of time when the ice within the ice-making container 12 is released from the ice-making container has elapsed, the heat generation should be stopped. However, if the heater 15 is not in the normal operating state, the heat may continue to be generated. Such a heat generation may have a fatal and adverse influence on the performance of the freezing chamber of the refrigerator.

Furthermore, the ice-releasing operation in the conventional ice maker is made by sensing a temperature of the ice-making container 12. Although it is not illustrated, the conventional ice maker is provided with a temperature sensing device for sensing the temperature of the ice-making container 12. After it is sensed on the basis of the temperature sensed by the temperature-sensing device whether the ice making has been completed, the ice-releasing operation is controlled. Therefore, turn-on/off operations of the heater are electrically controlled based on values sensed by the temperature-sensing device, whereby the ice-releasing operation is performed.

From the foregoing, it has been described that the conventional ice maker is provided with numerous electrical devices and is constructed such that the ice-making and ice-releasing operations are performed based on the sensed values and operations of the electrical devices. Accordingly, failure and malfunction of the electrical device and heat source constructed as such may have an adverse influence on the ice maker as well as even on the freezing chamber in which the ice maker is mounted.

As an example, in a case of the temperature sensing device, an operating error and failure rate thereof may greatly vary according to its unit price. If the temperature sensing device is shorted, there may be a case where the heater controlled to be turned on/off by the temperature sensing device is not normally operated. In particular, if the turn-off operation of the heater is not normally controlled due to a failure of the temperature sensing device, the amount of heat generated from the heater has an influence even on foods stored in the freezing chamber, and the stored foods are consequently deteriorated.

However, the conventional ice maker constructed as such has no means for confirming as to whether the above components thereof are normally operated. Thus, there has been a problem in that when the conventional ice maker is actually mounted and employed in the freezing and refrigeration equipment, it is difficult to confirm as to whether the ice maker is normally operated, and it is particularly difficult to regulate the amount of water which should be supplied to the ice-making container.

Moreover, since there is not provided a function of testing the ice maker, it is difficult to determine which component of the ice-maker causes any relevant failure. Thus, there has been another problem in that good service on the ice maker cannot be provided.

DISCLOSURE OF INVENTION

Consequently, the conventional ice maker has not fully satisfied requirements of the customers due to the aforementioned problems.

The present invention is, accordingly, contemplated to solve the above problems in the prior art. An object of the present invention is to provide a method of testing an ice maker for use in a refrigerator by which an operating state of the ice maker can be tested and a driving state of internal components thereof can also be checked for ensuring a normal operation of the ice maker.

Another object of the present invention is to provide an ice maker in which a size of ice is diversified by regulating an amount of water to be supplied into an ice-making container of the ice maker, thereby improving customer satisfaction.

According to one aspect of the present invention for accomplishing the objects, there is provided a method of testing an ice maker for a refrigerator, comprising: a test signal input step of inputting a test signal for checking an operating state of the ice maker; a specific operation checking step of checking specific operations of electrical components themselves installed within the ice maker when the test signal has been inputted; and a sequential operation checking step of sequentially checking operations of making and releasing ice in the ice maker when no malfunction has been found in the specific operation checking step.

Preferably, the sequential operation checking step comprises the steps of variably adjusting set values to be set during the respective operations and checking the operations based on the variably adjusted values.

Further, it is preferable that the ice maker be tested just after the ice maker has been installed in the refrigerator.

According to another aspect of the present invention, there is provided a method of testing an ice maker for a refrigerator, comprising: a test signal input step of inputting a test signal for checking an operating state of the ice maker; an initial position checking step of checking an initial position of a release means for separating ice from an ice-making container to which the ice is frozen and discharging the ice to an ice storage container when the test signal has been inputted; a water supply checking step of checking a water supply operation for supplying the ice-making container with water; an ice-making operation checking step of checking an operation for making the ice from the water supplied to the ice container; and an ice-releasing operation checking step of checking an operation for releasing the ice from the ice-making container.

Preferably, it is further confirmed in the initial position checking step as to whether motor power is normally transferred to the release means.

Preferably, a set value used in the initial position checking operation can be variably adjusted in the initial position checking step.

Preferably, it is confirmed in the water supply checking step as to whether a solenoid valve which is opened and closed to supply the water to the ice-making container is operated.

Preferably, driving duration of the solenoid valve can be variably adjusted in the water supply checking step.

Preferably, time and temperature used to control when the ice-making operation is completed can be variably adjusted in the ice-making operation checking step.

Preferably, it is confirmed in the ice-releasing operation checking step as to whether a heater for melting the ice is normally operated.

Preferably, driving time for performing an initial operation of the heater can be variably adjusted in the ice-releasing operation checking step.

According to a further aspect of the present invention, there is provided an ice maker for releasing ice of which lower portion melts by a heater with a driving force of a motor, comprising: a temperature sensor installed to the exterior of an ice-making container for sensing whether the ice has been made within the ice-making container; a first magnet installed to a gear rotated by the driving force of the motor for determining when the heater is turned off; a first hall sensor for sensing a magnetic force generated from the first magnet; a water amount regulating knob formed to protrude outside of the ice maker for regulating the amount of water supplied to the ice-making container; and a microcomputer for turning the heater on and off based on a sensing signal of the first hall sensor when a sensed temperature of the temperature sensor reaches a predetermined value, and regulating the amount of water supplied to the ice-making container based on a regulating signal transmitted from the water amount regulating knob.

Preferably, the ice maker further comprises an ice-releasing lever pivotally installed to a side of the ice maker; a second magnet installed to move together with the ice-releasing lever, and a second hall sensor for sensing a magnetic force generated from the second magnet, wherein a signal from the second hall sensor is transmitted to the microcomputer.

Preferably, according to the ice maker of the present invention, a third magnet is installed to the gear and a signal for setting an initial position of the ice-releasing lever is generated such that the ice-releasing lever is not immersed into the water supplied to the ice-making container while the water is supplied to the ice-making container.

Preferably, according to the ice maker of the present invention, a separate test switch for allowing a user to start performing a failure diagnosis of the ice maker and a LED for displaying results of the failure diagnosis thereon are provided on a front side of the ice maker.

Preferably, according to the ice maker of the present invention, a water amount display portion for informing a user of the amount of water set by the user is provided on a front side of the ice maker.

BRIEF DESCRIPTION OF DRAWINGS

The above and other objects and features of the present invention will become apparent from the following description of a preferred embodiment given in conjunction with the accompanying drawings, in which.

BEST MODE FOR CARRYING OUT THE INVENTION

Hereinafter, an ice maker for a refrigerator according to a preferred embodiment of the present invention and a method of testing the ice maker will be explained in detail with reference to the accompanying drawings.

Figure 1A:
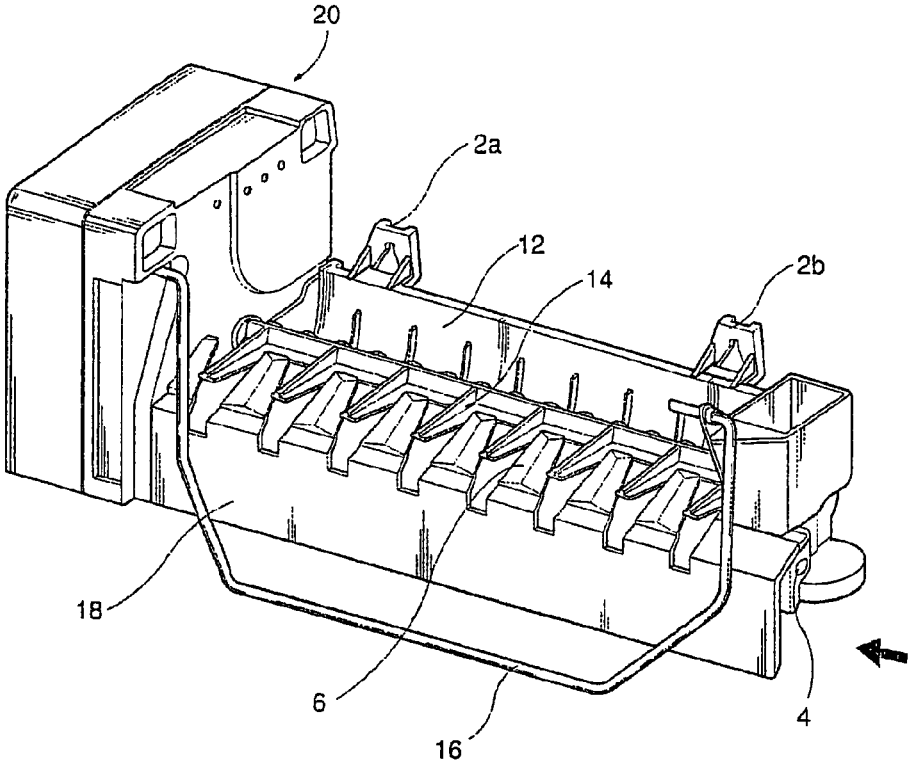
FIG. 1a CONVENTIONAL ART
FIGS. 1*a* and 1*b* are perspective views of a conventional ice maker for a refrigerator.
Figure 1B:
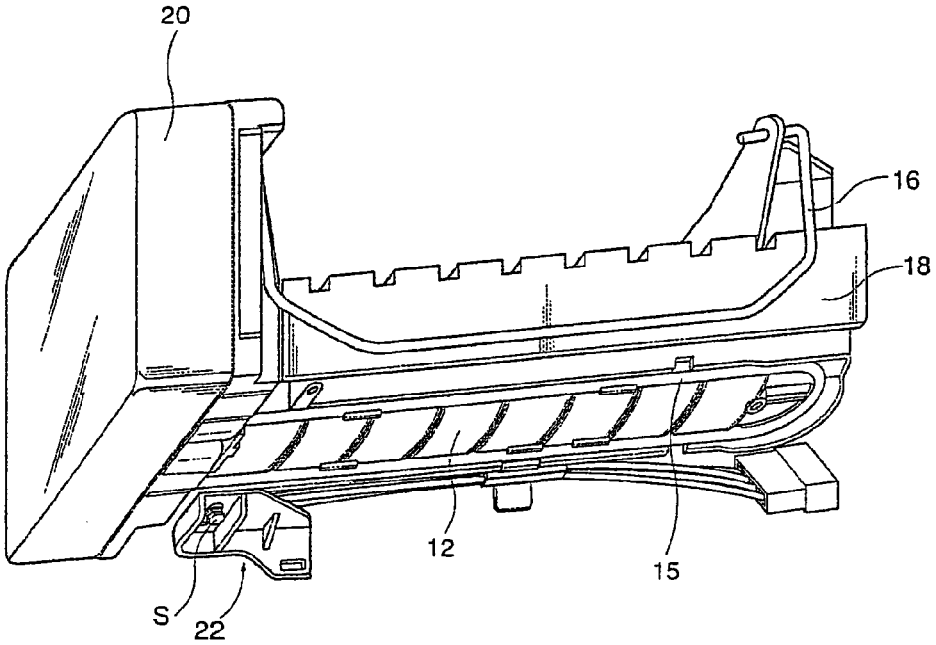
FIG. 1b CONVENTIONAL ART
Figure 2A:
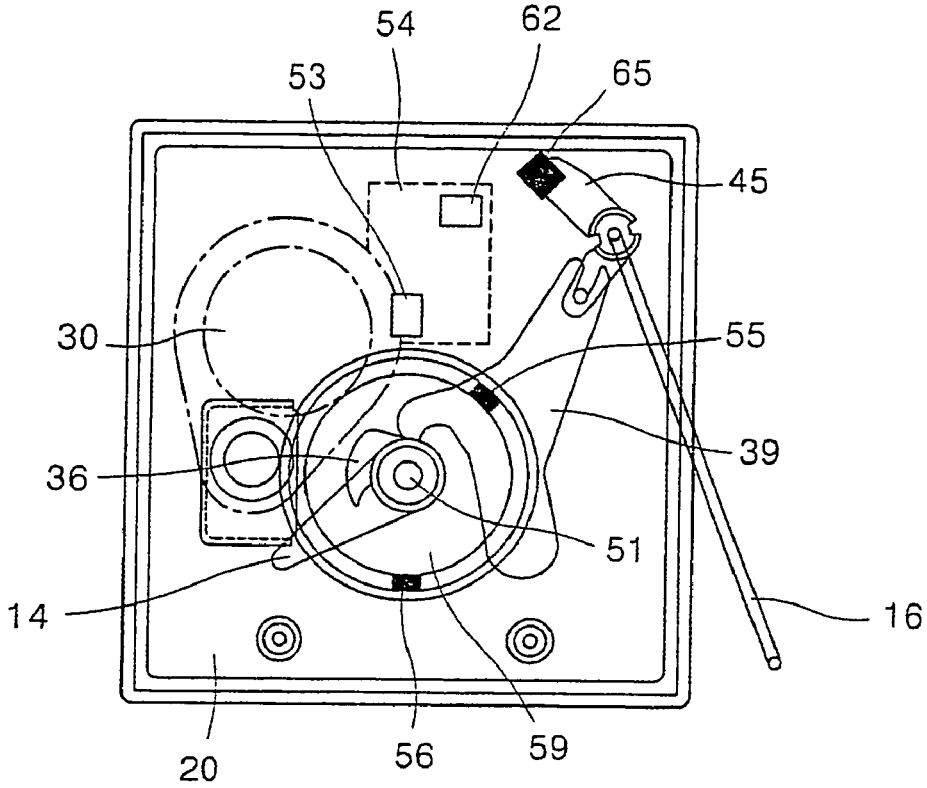
FIG. 2*a* is a view showing the inner constitution of a casing of an ice maker according to the present invention.
Figure 2B:
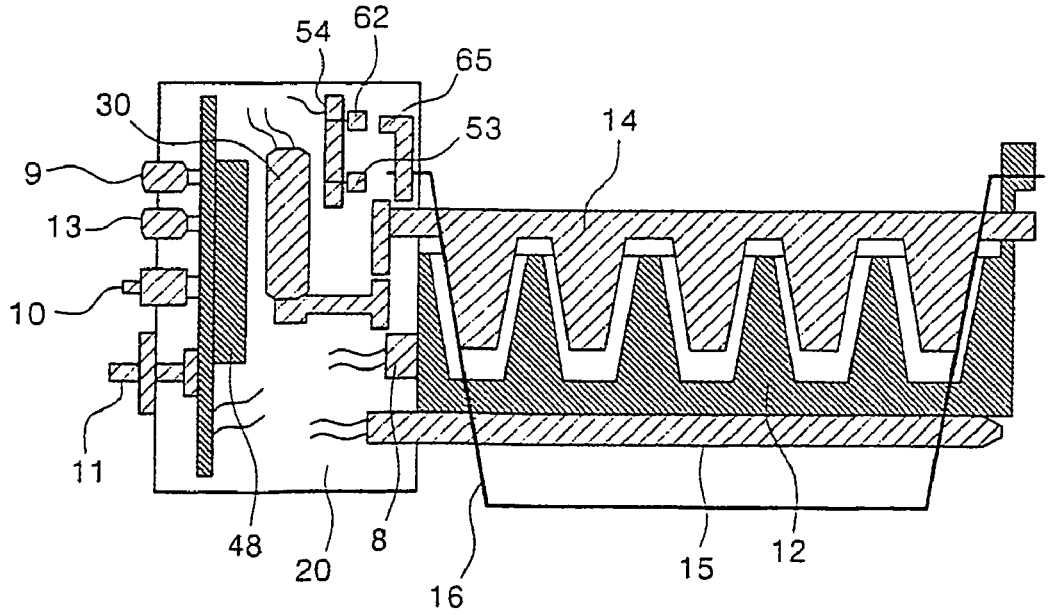
FIG. 2*b* is a side sectional view of the ice maker according to the present invention.

FIG. 2*a* shows an electrical configuration and a power transmission structure of various components installed within a casing of an ice maker for use in a refrigerator according to the present invention. FIG. 2*b* shows a side sectional view of the ice maker according to the present invention. FIG. 1 is also still used to explain the constitution of the ice maker of the present invention.

As shown in FIG. 2*b*, a control panel 48 for receiving signals from various kinds of electric devices and generating necessary control signals is provided within a casing 20 of the ice maker. The control panel 48 is provided with various kinds of control components, shown in FIG. 3, for controlling the ice maker according to the present invention. The various control components shown in FIG. 3 will be described later.

Further, the control panel 48 is electrically connected with a failure diagnosis result display LED 13 for displaying failure diagnosis results, a water amount display portion 9 for displaying the amount of water selected by a user, a water amount regulating knob 11 for regulating an operation period of time of a water supply valve so as to regulate the amount of water supplied into an ice-making container 12, and a test switch 10 for performing user's instructions on the start of a failure diagnosis of the ice maker, all of which protrude outside of the ice maker.

Furthermore, the ice maker includes a metallic ice-making container 12 attached to the casing 20 for making half moon shaped ice, a temperature sensor 8 for sensing a temperature of the ice-making container 12, an ice-releasing lever 14 coupled with a motor shaft at a top center portion of the ice-making container 12 for releasing the ice from the ice-making container 12, and a front plate IS for guiding the ice released by the ice-releasing lever 14 outwardly of the ice maker. A heater 15, from which heat used for separating the ice from the ice-mating container 12 is generated upon completion of the ice-making operation, is also installed below the ice-making container 12. The ice maker is further provided with an ice-detecting lever 16 for sensing whether an ice storage space has been filled up with the ice.

In addition, a motor 30 for generating a rotational force required in the ice maker is installed within the casing 20. Further, magnets 55, 56 and 65 for generating signals, which are used to transmit information on when the ice-making operation is started and when the ice-releasing operation is ended and started to a rotary gear 59 coupled with the motor, are installed within the casing 20. Hall sensors 53, 62 for sensing magnetic force generated from the magnets, converting the sensed magnetic force values into current values, and outputting signals corresponding to the converted current values to the control panel 48 are also installed within the casing 20.

The heater 15 explained herein is used for the ice-releasing operation of the ice maker. That is, a start of an operation of the heater 15 means the start of the ice-releasing operation, and a termination of the operation of the heater 15 means the completion of the ice-releasing operation. Thus, an on/off control of the heater 15 performed in the present invention will be explained in connection with a mechanism of the ice-releasing operation.

The motor 30 is used to generate a rotational force for rotating the ice-releasing lever 14 for the purpose of the ice-releasing operation of the ice maker. Moreover, the motor 30 also generates a rotational force for causing a cam 36 to rotate so as to sense whether the ice storage space has been filled up with the ice. That is, the motor 30 is to generate a power required for the ice maker.

As shown in the figures, the hall sensors and magnets are employed for sensing a position of the ice-releasing lever in the present invention. That is, the first magnet 56 is installed at an end of the gear 59 which is rotated by means of the rotational force of the motor 30. The control panel 48 is installed at an inner side of the casing 20, and the first hall sensor 53 is installed at a sub-board 54 which is electrically connected with the control panel 48. Although it is described in the illustrated embodiment of the present invention that the first hall sensor 53 is installed to the sub-board 54, the first hall sensor 53 may be installed directly to the control panel 48.

Further, the ice-releasing lever 14 is mounted to a shaft 51 of the gear 59. That is, it is meant that the ice-releasing lever 14 is also rotated by the same amount of rotation as that of the gear 59. Thus, when the first magnet 56, which is mounted to the end of the gear 59 rotating together with the motor 30, is located at a detection position of the first hall sensor 53, a detection signal of an initial position of the ice-releasing lever 14 is caused to be outputted from the first hall sensor 53. Therefore, the first hall sensor 53 and the first magnet 56 should be installed at positions where the initial position of the ice-releasing lever 14 can be detected.

Further, the other third magnet 55 is mounted to another side of the gear 59. It is constructed such that the first hall sensor 53 also detects the third magnet 55. The third magnet 55 is mounted at a predetermined position such that it can be physically sensed when the ice is completely released from the ice-making container 12 by the ice-releasing lever 14 rotated by the motor. Thus, when the first hall sensor 53 detects the third magnet 55 after detecting the first magnet 56, it is determined that the ice-releasing operation has been completed.

In addition, the cam 36 is mounted to the rotary shaft 51 of the gear 59. It is also constructed such that the cam 36 receives the rotational force from the rotary shaft 51. An action of the cam 36 is transmitted to an arm lever 39 for moving the ice-detecting lever 16 upward and downward. It is because an end of an extension portion 45, which is moved together with the ice-detecting lever 16, can be pivotally moved as much as the arm lever 39 rotates.

Furthermore, the second magnet 65 is installed at one side of the extension portion 45. The second hall sensor 62 for detecting a position of the second magnet 65 is mounted to a portion of the sub-board 54, and thus, the second hall sensor 62 is installed at a predetermined location such that it can be sensed by the ice-detecting lever 16 whether the ice storage space has been filled up with the ice. Therefore, when the second magnet 65 is located at a detection position of the second hall sensor 62, a detection signal serving as a signal for confirming as to whether the ice has filled up the ice storage space is outputted from the second hall sensor 62.

Figure 3:
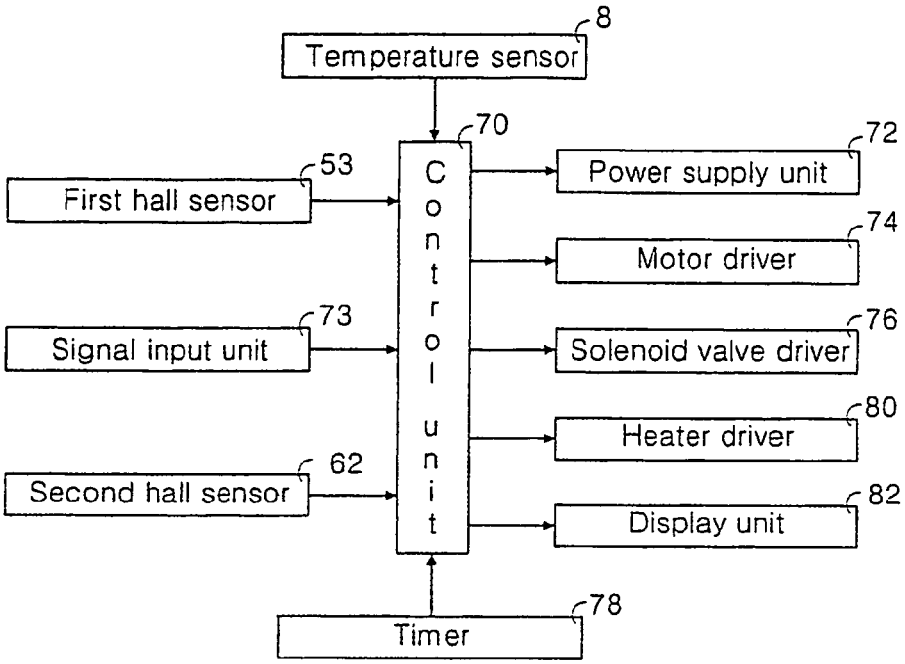
FIG. 3 is a block diagram showing a configuration for controlling the ice maker according to the present invention.

FIG. 3 is a block diagram showing a configuration for controlling the ice maker according to the present invention.

The first hall sensor 53 is a sensor for sensing whether the ice-releasing lever 14 is located at its initial position. The first hall sensor 53 is designed to output the detection signal of the initial position of the ice-releasing lever when detecting the first magnet 56.

The aforementioned initial position is a specific position where the ice-releasing lever 14 is located above a space defined by the ice-making container 12, as shown in FIG. 1. However, the initial position of the ice-releasing lever 14 does not need to be limited to the position shown in FIG. 1. That is, any positions that are not included within a range of the space defined by the ice-making container 12 may be set as the initial position of the ice-releasing lever.

In the meantime, when the first hall sensor 53 detects the third magnet 55 after detecting the first magnet 56, a signal for indicating the completion of the ice-releasing operation is outputted. At this time, an angular interval between the first and third magnets 56, 55 should be always set such that a moment when the ice is released from the ice-making container can be physically sensed. It means that a location of the third magnet 55 should also be changed depending on change of the initial position of the first magnet 56.

The second hall sensor 62 is a sensor for sensing whether the ice-detecting lever 16 is located at a predetermined position corresponding to where the ice storage space is filled up with the ice. The second hall sensor 62 is designed to output the detection signal when detecting the second magnet 55.

The detection signal of the initial position outputted from the first hall sensor 53 is inputted into a control unit 70. The control unit 70 determines the initial position of the ice-releasing lever 14 based on the signal outputted from the first hall sensor 53. The detection signal outputted from the second hall sensor 62 is also inputted into the control unit 70. The control unit 70 also determines whether the ice storage space is filled up with the ice, based on the signal outputted from the second hall sensor 62.

Further, if a signal indicating that the first hall sensor 53 has detected the third magnet 55 is inputted into the control unit 70 within a predetermined period of time after the first hall sensor has determined the initial position of the ice-releasing lever 14 by detecting the first magnet 56, the control unit 70 determines that the ice-releasing operation has been completed. That is, it is determined as the time when the operation of the heater performed during the ice-releasing operation is turned off. Thus, the completion of the ice-releasing operation by detection of the third magnet 55 is made in the course of the ice-releasing operation of the ice maker.

Referring to FIG. 2*a*, the two first and second hall sensors 53, 62 are mounted to the sub-board 54. The sub-board 54 mounted with the two hall sensors is electrically connected with the control panel 48, and the two hall sensors are constructed such that they can be controlled and supplied with electric power at a time. Further, the control unit 70 shown in FIG. 3 is installed onto the control panel 48.

The control unit 70 performs the control of supplying the first and second hall sensors with the electric power so that the signal detecting operations by the two hall sensors can be made. The control is simultaneously accomplished through the power supply unit 72. The power supply unit 72 is constructed such that the electric power is supplied to a component requiring the electric power, i.e. the temperature sensor 8 to be described below, as well as the two hall sensors.

Further, a motor driver 74 for driving the motor 30 and a solenoid valve driver 76 for driving a solenoid valve (not shown) upon supply of the water into the ice-making container 12 through the water supply tube connector 4 are included in the control components of the ice maker according to the present invention. Reference numeral 78 designates a timer for selectively counting the time at need, and reference numeral 8 designates the temperature sensor for sensing the temperature of the ice-making container 12 and then transmitting the sensed temperature to the control unit 70.

A heater driver 80 for driving the heater 15 is also employed in the present invention. The heater driver 80 performs an on/off control of the operation of the heater 15 under the control of the control unit 70. In particular, the heater 15 will be preferably terminated when the first hall sensor 53 detects the third magnet 55.

Reference numeral 73 designates a signal input unit. The signal input unit of the present invention includes the test switch 10 which protrudes outside of the ice maker so that the switch can be selected by the user. If the test switch 10 is selected, the control unit 70 starts to check all the components of the ice maker.

Thus, the control unit 70 must have a function of checking all the components of the ice maker whenever the test switch 10 is selected. The check function of the control unit is to test the water supply operation, the ice-making operation, the ice-releasing operation, and the like as a whole.

In addition, the signal input unit 73 is formed to protrude outside of the ice maker and includes the water amount regulating knob 11 through which the user can regulate the amount of water supplied. The water amount regulating knob 11 outputs a signal for allowing the amount of water supplied to the ice maker to be increased in proportion to an amount of rotation thereof. The signal is inputted into the control unit 70 which in turn adjusts driving duration of the solenoid valve according to the variable amount of rotation of the water amount regulating knob. At this time, a maximum amount of rotation of the water amount regulating knob is restricted to a maximum capacity with which the ice can be made within the ice-making container 12.

Reference numeral 82 designates a display unit. The display unit 82 is a device for displaying a signal thereon under the control of the control unit 70. The display unit 82 includes the water amount display portion 9, the failure diagnosis result display LED 13, and the like, as shown in FIG. 2*b*.

Among the control components of the ice maker, the components excluding the sensors, the signal input unit, and the display unit are installed on the control panel 48. Any control device such as a microcomputer can be used as the control unit 70.

Next, an operating process of testing the ice maker for use in the refrigerator according to the present invention constructed as such will be described.

Figure 4:
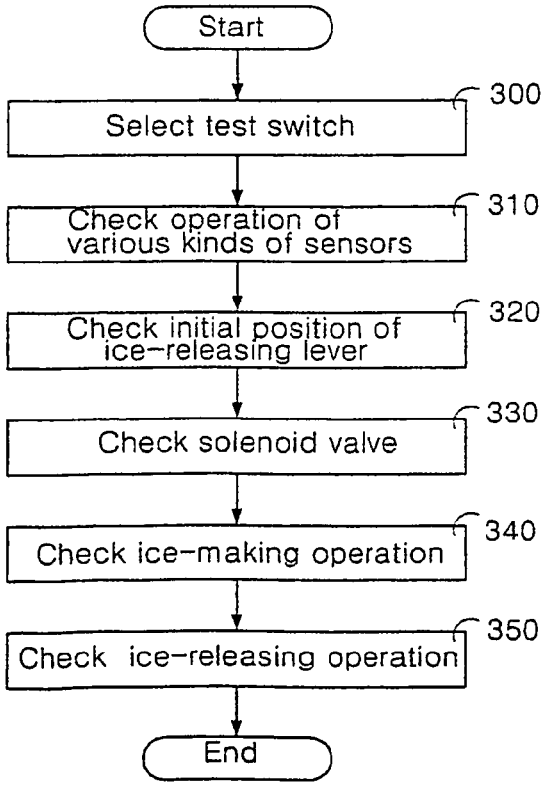
FIG. 4 is a flowchart illustrating a process of testing the ice maker according to the present invention.

FIG. 4 is a flowchart illustrating a process of testing the ice maker according to the present invention.

If the user selects the test switch 10 provided in the signal input unit 73, the control unit 70 starts to check the driving state of all the components needed for a normal operation of the ice maker (step 300).

First, the control unit 70 checks the driving state of various kinds of the sensors provided in the ice maker (step 310). For example, the control unit 70 can determine whether the temperature sensor 8 is normally operated by detecting the signal inputted to the control unit 70 from the temperature sensor S in a state where the electric power supplied to the temperature sensor 8 is cut off. In addition to this method, the control unit can determine whether the temperature sensor 8 is normally operated by comparing a reference value with a detected value by the temperature sensor 8 at an initial stage of or during the operation thereof. At this time, the reference value is set within a range of temperature which can be detected when the temperature sensor 8 is normally operated.

Further, the operation of the first and second hall sensors 53, 62 is also checked in step 310. That is, step 310 is a step of determining whether various kinds of the sensors employed in the ice make of the present invention are normally operated. Furthermore, it is also determined in step 310 whether various kinds of electrical components employed in the ice maker are normally operated. That is, the operating state of all the components shown in FIG. 3 can be confirmed or checked based on the reference values outputted from control unit 70 for determining whether they are normally operated.

If it is determined in step 310 whether the various kinds of sensors are normally operated all together, the control unit 70 performs the checking operation of determining whether the ice-releasing lever 14 can be normally located at the initial position thereof (step 320).

Figure 5:
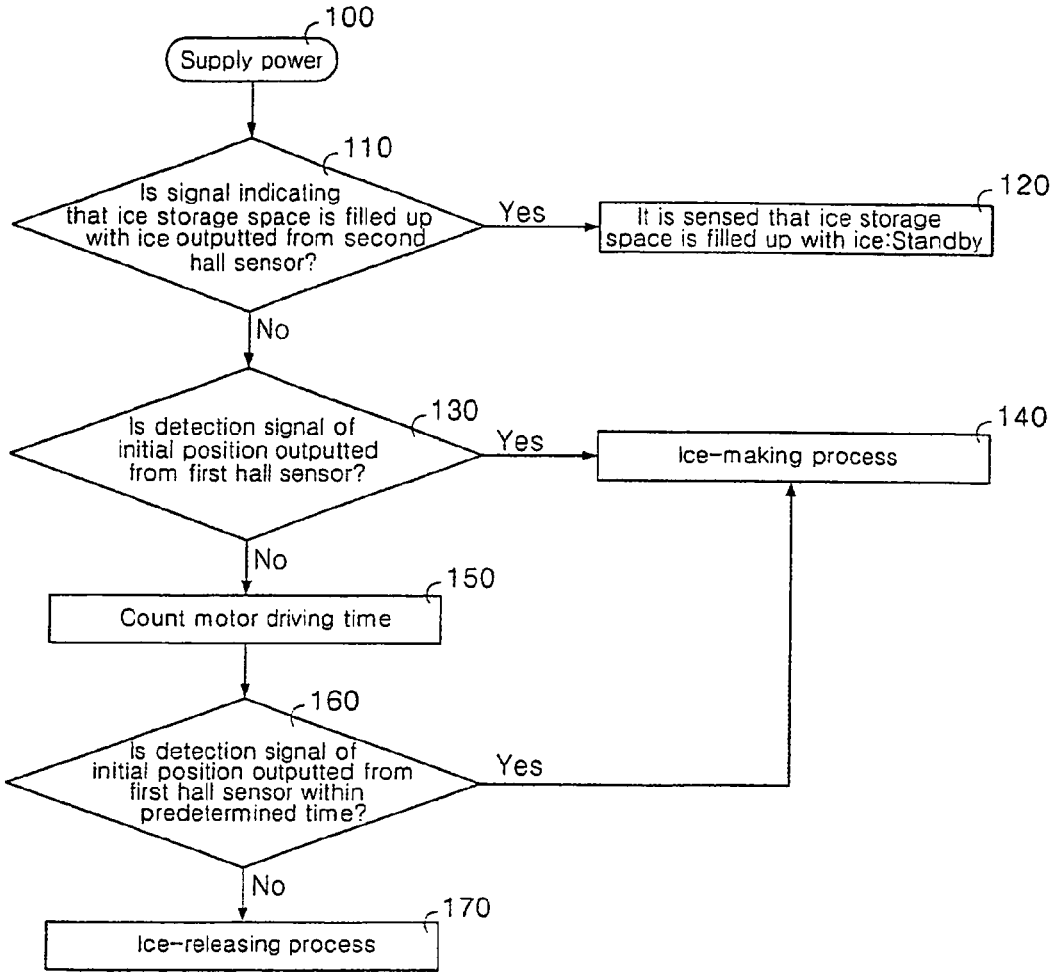
FIG. 5 is a flowchart illustrating a process of testing an initial position of an ice-releasing lever according to the present invention.

FIG. 5 shows an additional operating process subordinate to step 320.

If the ice maker is supplied with the electric power, the control unit 70 outputs a driving signal to the power supply unit 72 and causes the first and second hall sensors 53, 62 installed at the sub-board 54 to be supplied with the electric power (step 100). Thus, it becomes a standby state where the first and second hall sensors are ready to detect the first and second magnets.

Then, the control unit 70 first confirms as to whether the detection signal has been outputted from the second hall sensor 62 (step 110).

In the ice maker of the present invention, it is sensed by an up and down rotation of the ice-detecting lever 16 whether the ice storage container is filled up with the ice. The up and down rotation of the ice-detecting lever 16 is performed in such a manner that when the gear 59 is rotated with the driving force of the motor transmitted thereto, the action of the cam 36 rotating together with gear 59 is transferred through the arm lever 39 to the ice-detecting lever 16.

Figure 9A:
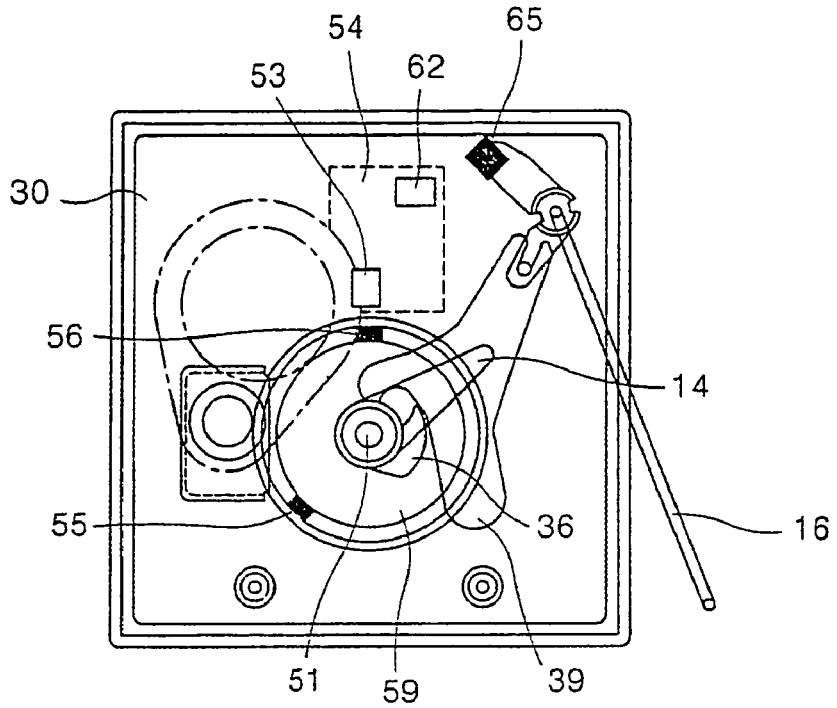
FIGS. 9*a*, 9*b* and 9*c* are views showing various operating state of the ice maker according to the present invention.
Figure 9B:
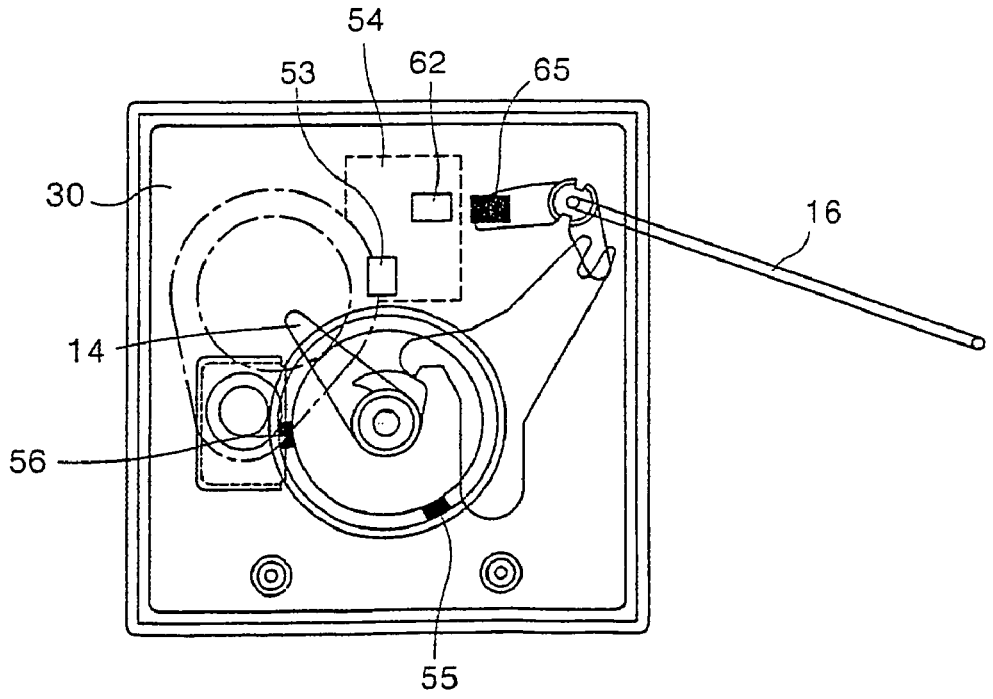

Thus, when the ice-detecting lever 16 moved upwardly by the action of the cam 36 is located as shown in FIG. 9*b*, the second hall sensor 62 detects the second magnet 65 and the detected signal is transmitted or outputted to the control unit. At this time, if an ice storage container (not shown) to be mounted below the ice-making container is not filled up with the ice, the ice-detecting lever 16 is returned to a lower position thereof, as shown in FIG. 2*b*, after the action of the cam 36 has been competed, i.e. when the arm lever 39 comes into contact with the cam 36 no longer. That is, in a case where the ice storage container is not filled up with the ice, the detection signal outputted while the second hall sensor 62 detects the second magnet 65 is interrupted within a predetermined period of time.

The aforementioned up and down operation of the ice-detecting lever 16 is periodically performed whenever the motor 30 is driven for the ice-releasing operation.

However, if the ice storage container is filled up with the ice, the upwardly moved ice-detecting lever 16 remains at a position shown in FIG. 9*b* even after the rotation of the gear for performing the ice-releasing operation has been completed. At this time, the signal generated when the second hall sensor 62 detects the second magnet 65 is continuously outputted for more than the predetermined period of time. Thus, the control unit 70 can detect the fully filled state by means of the lasting detection signal of the second hall sensor 62.

Accordingly, step 110 is to control the ice maker so that the ice-making operation is performed no longer when it is sensed on the basis of the detection signal of the second hall sensor 62 that the ice storage container has been filled up with the ice. That is, even though new ice is made through any further ice-making and ice-releasing operations and then falls into the ice storage container, the ice is likely to fall again out of the ice storage container since the ice storage container for accommodating the ice therein has been already filled up with the ice. Thus, such a case should be beforehand prevented (step 120).

On the other hand, if it is determined in step 110 that the ice storage container is not filled up with the ice, the control unit 70 determines whether the first hall sensor 53 has detected the initial position of the ice-releasing lever 14 (step 130). That is, it is determined whether the signal obtained when the initial position of the ice-releasing lever 14 is detected is outputted from the first hall sensor 53.

The position of the ice-releasing lever 14 is determined according to the rotation of the motor 30. That is, when the gear 59 is rotated with the rotational force of the motor 30 transmitted thereto, the ice-releasing lever 14 coupled with the rotary shaft 51 of the gear 59 is also rotated.

Furthermore, the first magnet 56 is mounted to any one end of the gear 59. Thus, when the gear 59 is rotated to a certain extent, the first magnet 56 is detected by the first hall sensor 53. At this time, the first hall sensor 53 outputs the detection signal of the initial position of the ice-releasing lever. Thus, if it is determined in step 130 that the detection signal of the initial position of the ice-releasing lever is not outputted from the first hall sensor 53, this is a case where the ice-releasing lever 14 is located at any positions other than the initial position. In particular, if the ice-releasing lever 14 is located within the space defined by the ice-making container 12, there is likelihood that the ice-releasing lever may be frozen with the water in the container. Consequently, the control unit 70 should determine, in step 130, whether the detection signal of the initial position of the ice-releasing lever 14 has been outputted from the first hall sensor 53.

In a case where the detection signal is not outputted from the first hall sensor 53 in step 130, the control unit 70 sends a motor driving signal to the motor driver 74. Thus, if the motor 30 is driven, the gear 59 is also rotated and causes the ice-releasing lever 14 to rotate. After the timer 78 has been initialized while the motor is driven, a motor driving time is counted (step 150).

If the detection signal of the initial position of the ice-releasing lever obtained by detecting the first magnet 56 is outputted from the first hall sensor 53 before the motor driving time counted in step 150 exceeds a predetermined time (step 160), the control unit 70 sets a current position as the initial position of the ice-releasing lever 14. Such an operating state is shown in FIG. 9*a*.

The predetermined time defined in step 160 is set as a time obtained by adding an adequate compensation value to a time required for one revolution of the ice-releasing lever 14. In general, the time required for one revolution of the ice-releasing lever 14 is set as about three (3) minutes. Thus, it is preferred that the predetermined time be set as about four (4) minutes.

If it is in a normal state, the ice-releasing lever 14 can sufficiently turn one revolution within the predetermined time set in step 160. Thus, even though the lever is located at a farthest position from the initial position thereof, the detection of the lever can be sufficiently accomplished within the predetermined time. A driving speed of the motor must always be kept constant. It is required even for the control operation performed in step 160.

However, unless the detection signal of the first magnet 56 is outputted from the first hall sensor 53 within the predetermined time, it is determined that the rotation of the gear 59 driven by the motor 30 is abnormal. For example, in a case where the ice-releasing lever 14 is frozen with the water, the gear 59 cannot be normally rotated since it is restrained from being rotated.

Therefore, if the initial position of the ice-releasing lever 14 is detected within the predetermined time in step 160, it goes into an ice-making process performed in step 140. Otherwise, it goes into an ice-releasing process performed in step 170.

The ice-releasing process of step 170 is to forcibly perform the ice-releasing process by using heat generated from a heater (not shown). For example, it is forcibly performed when the ice-releasing lever 14 is frozen with the water.

Further, if it goes into the ice-making process of step 140, the ice-releasing lever 14 gets out of the space defined by the ice-making container 12 as shown in FIG. 1. Thus, the ice-releasing lever 14 can be prevented from being frozen with the water in the container.

As mentioned above, in step 320 of FIG. 4 for checking the initial position of the ice-releasing lever 14, it is sensed whether the ice-releasing lever 14 is normally located at the initial position thereof within the predetermined time, whether the driving force of the motor is transferred to the ice-releasing lever 14 for the purpose of the normal rotation thereof, or the like. In addition, it is sensed whether it is normally checked, based on the detected value by the second hall sensor 62, that the ice storage container is filled up with the ice. Furthermore, the control unit 70 can variably adjust an initial value of the predetermined time set in step 160 through the checking processes.

Figure 6:
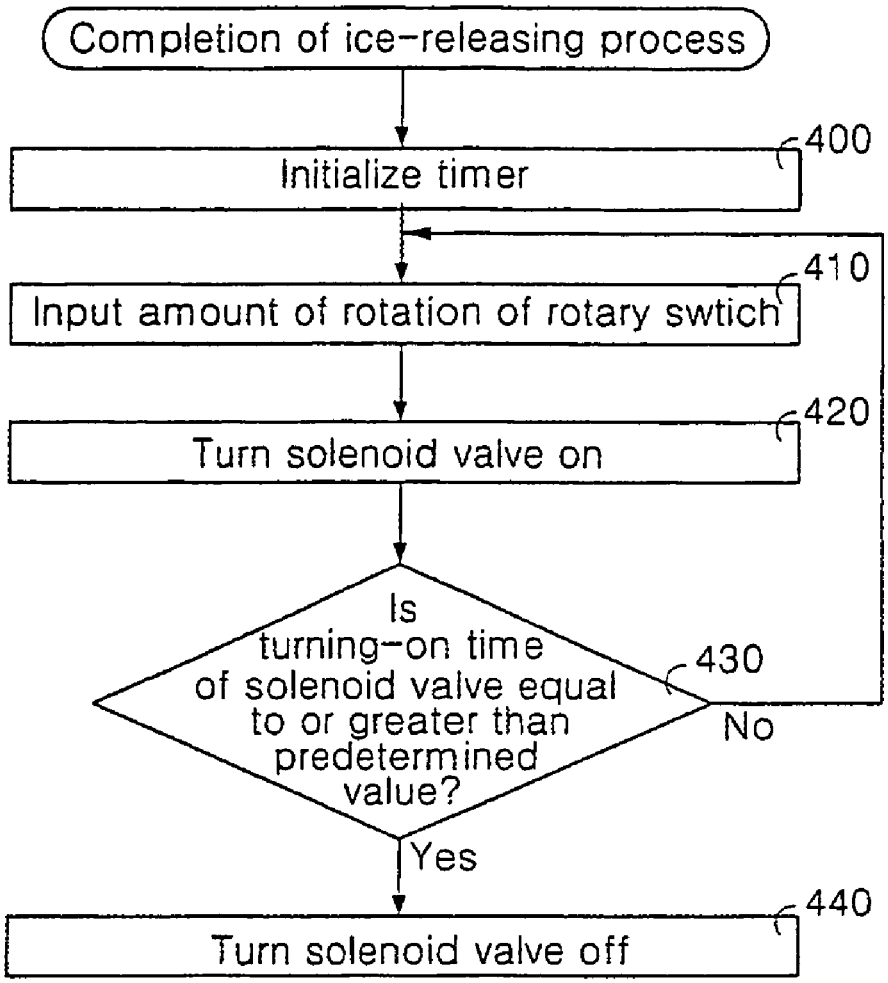
FIG. 6 is a flowchart illustrating a process of testing water supplying operations according to the present invention.

Next, a process of checking the solenoid valve in step 330 will be performed. FIG. 6 shows an additional operating process subordinate to step 330 for checking the solenoid valve.

The solenoid valve is to regulate the amount of water supplied to the ice-making container 12. That is, the amount of water supplied to the ice-making container 12 is regulated under the control of the control unit 70, based on the signal applied to the solenoid valve driver 76.

Thus, in order to regulate the amount of water supplied to the ice-making container 12, the control unit 70 first initializes the timer 78 (step 400).

Then, the control unit reads the amount of rotation of the water amount regulating knob 11 in the signal input unit 73, which is adjusted by the user. The control unit 70 recognizes time duration of water supply that has been predetermined in proportion to the amount of rotation of the water amount regulating knob 11 (step 410).

The control unit 70 applies the driving signal to the solenoid valve driver 76 so as to cause the solenoid valve to be driven during the duration of water supply recognized in step 410 (steps 420 and 430).

While the solenoid valve is driven in the above steps, the ice-making container 12 is supplied with the water and the timer 78 counts a driving time of the solenoid valve. After the driving time counted in the timer 78 reaches a predetermined value, the control unit 70 turns off the operation of the solenoid valve (step 440).

Thus, the user can adjust the amount of water supplied to the ice-releasing container 12. Therefore, according to the water supplying operation illustrated in FIG. 6, the driving time of the solenoid valve is adjusted by turning the water amount regulating knob 11 in the signal input unit 73 until the proper amount of water is supplied to the ice-making container 12.

If the process of checking the solenoid valve performed in step 330 is completed, the ice-making operation of step 340 is checked.

Figure 7:
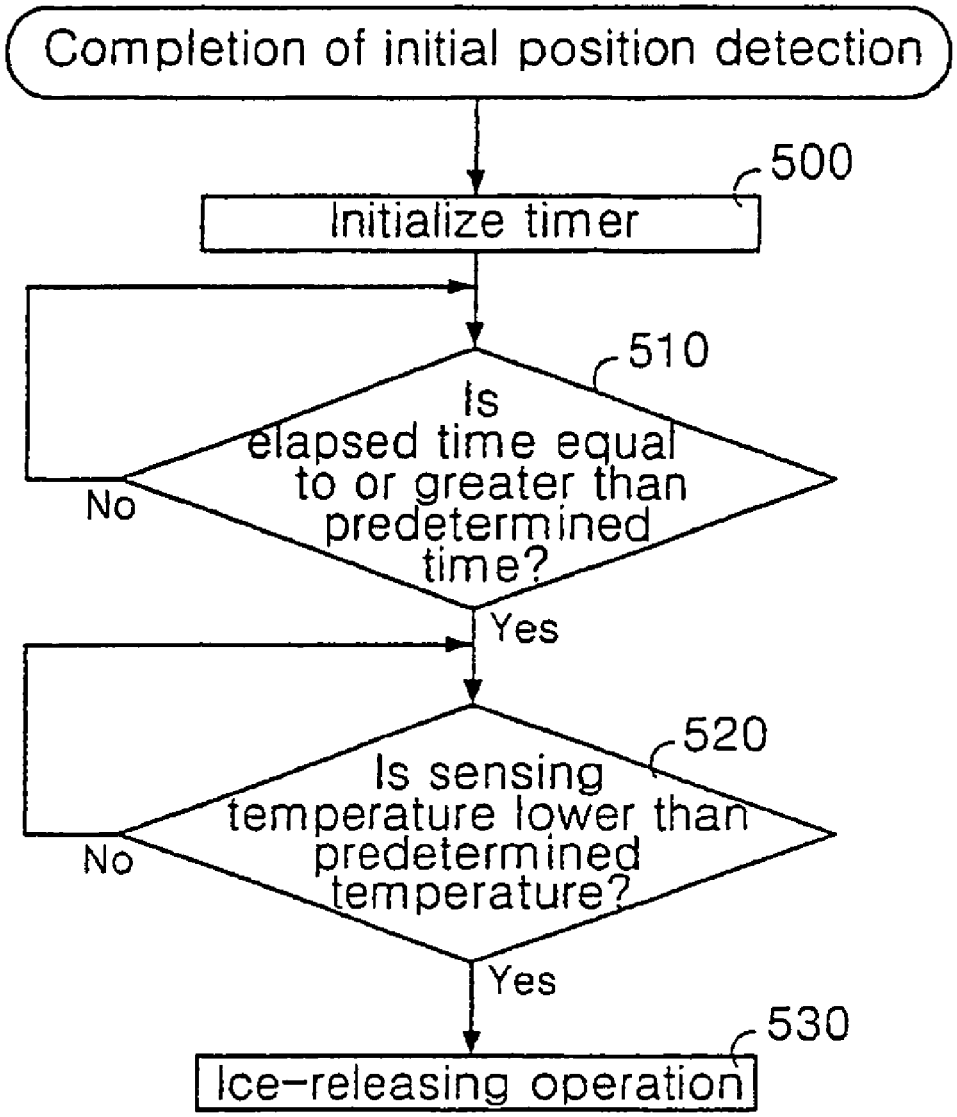
FIG. 7 is a flowchart illustrating a process of testing ice-making operations according to the present invention.

FIG. 7 shows an additional operating process subordinate to step 340 for checking the ice-making operation.

After the initial position of the ice-releasing lever is normally detected according to the process of FIG. 5 and the proper amount of water is then supplied to the ice-making container 12 according to the water supplying process shown in FIG. 6, the ice-making operation is performed.

The control unit 70 initializes the timer 78 (step 500). After the ice-making operation is started, it is determined whether a period of time counted in the timer 78 has exceeded a predetermined period of time, i.e. about an hour (step 510). The predetermined period of time should be set sufficiently to perform the ice-making operation.

Further, the control unit 70 determines whether a temperature, which is sensed by the temperature sensor 8 mounted to the ice-making container 12 for detecting the temperature of the container, has reached a predetermined temperature at which the ice has been completely made in the container (step 520). The predetermined temperature used in step 520 should also be set to sufficiently perform the ice-making operation.

If the conditions of steps 510 and 520 are satisfied, the control unit 70 determines that the ice-making operation has been completed.

That is, in order to check the ice-making operation according to the process of FIG. 7, the period of time in step 510 and the temperature in step 520, which are used to monitor whether the ice-making operation has been completed, should be properly set. Thus, it is monitored whether the ice-making operation is normally performed according to the set period of time and temperature, and the period of time and temperature should be adjusted according to the monitored result.

Figure 8:
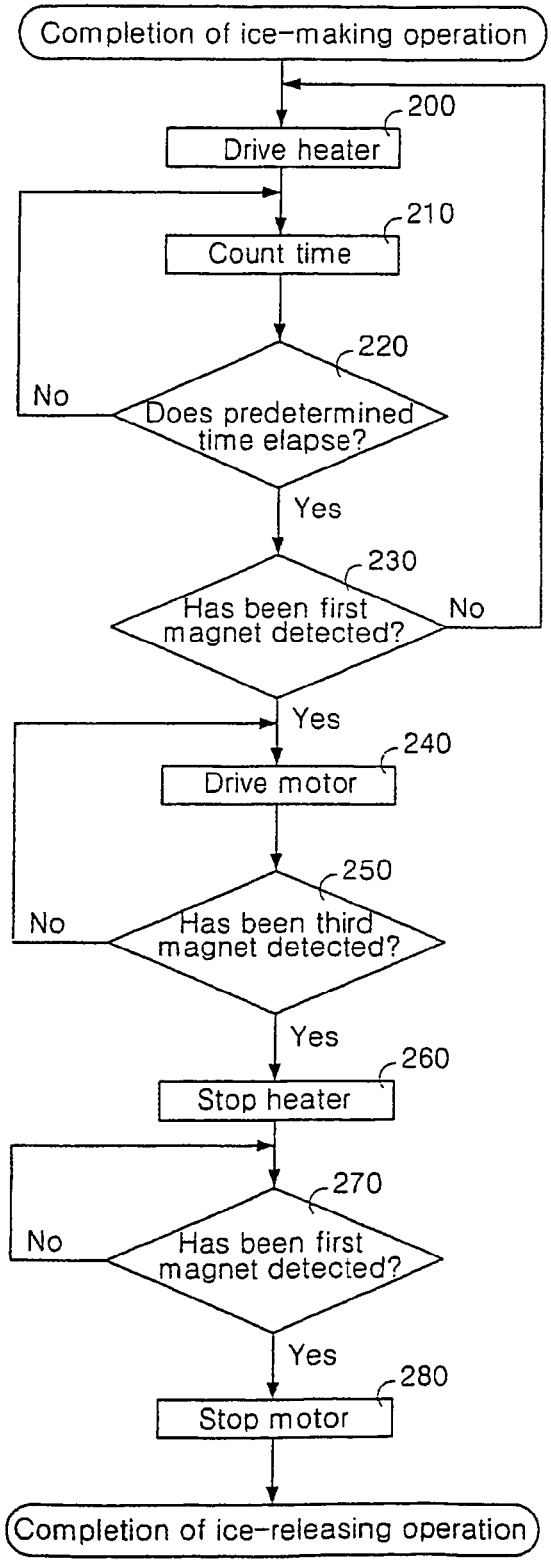
FIG. 8 is a flowchart illustrating a process of testing ice-releasing operations according to the present invention.

Finally, the ice-releasing operation is checked (step 350). FIG. 8 shows an additional operating process subordinate to step 350 for checking the ice-releasing operation.

When the temperature sensed by the temperature sensor 8 reaches the predetermined temperature at which the ice has been completely made in the ice-making container, the control unit 70 outputs the driving signal to the heater driver 80. The heater 15 starts to generate the heat in response to the signal (step 200).

Then, the heat generated from the heater is transferred to the ice-making container 12. Thus, a lower portion of the ice frozen to the ice-making container 12 melts a little, and the ice is able to move with respect to the container.

The control unit 70 causes the timer 78 to count a period of time while operating the heater 15 (step 210). The count of the period of time is to provide a predetermined period of time during which the lower portion of the ice can melt by the heat generation of the heater 15. Thus, the predetermined period of time used in step 220 is set such that the lower portion of the ice can melt within the period of time.

Further, the control unit 70 causes the first hall sensor 53 to detect the initial position of the ice-releasing lever 14 by detecting the first magnet 56, before driving the motor (step 230). As described above, since the ice-making operation is performed at the initial position of the ice-releasing lever 14, the initial position of the ice-releasing lever 14 can be easily detected if the ice-making operation has been normally performed. Such an operating state is shown in FIG. 9*a*.

Then, the control unit 70 applies the driving signal to the motor driver 74 so as to cause the motor 30 to be driven (step 240).

If the motor 30 is driven in step 240, the rotational force generated from the motor is transferred to the gear 59, and thus, the ice-releasing lever 14 is rotated together with the gear 59. Further, the third magnet 55 mounted to the other end of the gear 59 is also rotated.

At this time, as the ice-releasing lever 14 is rotated, the ice in the ice-making container 12, of which lower portion melts by means of the heat generated from the heater, is gradually pushed out of the ice-making container 12 by the ice-releasing lever 14. Such an operation is continuously performed while the ice-releasing lever 14 is rotated, and thus, the ice is released from the ice-making container 12 and then falls into the ice storage container positioned below the ice maker.

Figure 9C:
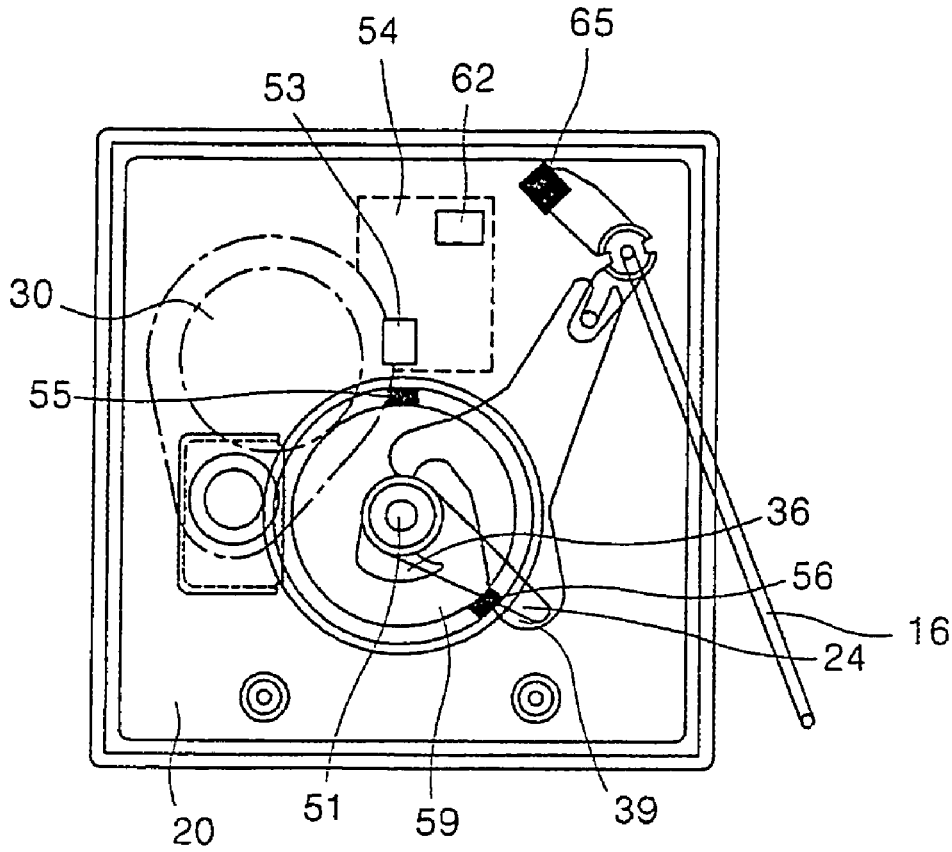

Further, since the ice-releasing lever 14 is rotated together with the gear 59, the first hall sensor 53 detects the third magnet 55 at a moment when the releasing lever 14 causes the ice to be released from the ice-making container 12 (step 250). The control unit 70 receives the detected signal, and then, it recognizes that the ice has been completely released from the ice-making container 12. Such an operating state is shown in FIG. 9*c*.

Thus, the control unit 70 outputs a stop signal to the heater driver 80 and causes the heater 15 to stop generating the heat (step 260).

After the heater operation is controlled as such, the motor 30 is continuously driven until the first hall sensor 53 detects the first magnet 56 again (steps 270 and 280). Then, the motor is stopped, and thus, the ice-releasing operation is completed.

That is, in the process of FIG. 8 for checking the ice-releasing operation, the driving time for performing initial operation of the heater is adjusted. Further, it is checked whether the heater is normally operated, and particularly, it is sensed whether the heater is normally turned off according to the state where the respective magnets are detected.

According to the present invention constructed as such, the driving state of all the components needed for the normal operation of the ice maker can be checked and the initial set values thereof can also be variably adjusted. That is, it is a basic technical spirit of the present invention that the function of testing all the components is incorporated into the ice maker to determine whether the components are normally operated. Further, it is determined whether the initial set values thereof are appropriate, and the initial set values can be adjusted.

According to the present invention, there are the following advantages.

First, since the supply of water and the duration thereof are controlled electrically, the supply of water can be accurately and timely made. Thus, the failure related to the supply of water can be minimized.

Second, since the water supply time and the ice-making time are simultaneously controlled and adjusted, the amount of ice made can be increased.

Third, since it can be determined through the use of the test function whether the ice maker is normally operated, quick service can be provided when something is wrong with the ice maker.

Fourth, since the user is able to directly regulate the amount of water supplied to the ice-making container, a size of the ice can be variably adjusted.

Fifth, since programmable control is made to the control components by the microcomputer, operating accuracy and reliability of the components can be greatly enhanced.

Although the invention has been described with respect to the preferred embodiment, the embodiment is intended not to limit the present invention. It will be understood by those skilled in the art that various changes and modifications may be made to the present invention without departing from the spirit and scope of the invention. Therefore, the scope of the present invention should be construed as being limited only by the appended claims, and as covering all the changes and modifications.

The invention claimed is:

1. A method of testing an ice maker for a refrigerator, comprising:

a test signal input step of inputting a test signal for checking an operating state of the ice maker;

a specific operation checking step of checking specific operations of electrical components themselves installed within the ice maker when the test signal has been inputted; and a sequential operation checking step of sequentially checking operations of making and releasing ice in the ice maker when no malfunction has been found in the specific operation checking step, wherein the sequential operation checking step comprises variably adjusting set values to be used during the respective operations and checking the operations based on the variably adjusted values.

2. The method as claimed in claim 1, wherein the ice maker is tested just after the ice maker has been installed in the refrigerator.

3. A method of testing an ice maker for a refrigerator, comprising:

a test signal input step of inputting a test signal for checking an operating state of the ice maker;

an initial position checking step of checking an initial position of a rotating release means for separating ice from an ice-making container to which the ice is frozen and discharging the ice to an ice storage container when the test signal has been inputted, wherein the initial position of the rotating release means is checked by detecting the initial position prior to a complete rotation of the rotating release means;

a water supply checking step of checking a water supply operation for supplying the ice-making container with water;

an ice-making operation checking step of checking an operation for making the ice from the water supplied to the ice container; and an ice-releasing operation checking step of checking an operation for releasing the ice from the ice-making container.

4. The method as claimed in claim 3, wherein in the initial position checking step, it is further confirmed as to whether motor power is normally transferred to the release means.

5. The method as claimed in claim 4, wherein in the initial position checking step, a set value used in the initial position checking operation can be variably adjusted.

6. The method as claimed in claim 3, wherein in the water supply checking step, it is confirmed as to whether a solenoid valve which is opened and closed to supply the water to the ice-making container is operated.

7. The method as claimed as claim 6, wherein in the water supply checking step, driving duration of the solenoid valve can be variably adjusted.

8. The method as claimed in claim 3, wherein in the ice-making operation checking step, time and temperature used to control when the ice-making operation is completed can be variably adjusted.

9. The method as claimed in claim 3, wherein in the ice-releasing operation checking step, it is confirmed as to whether a heater for melting the ice is normally operated.

10. The method as claimed in claim 9, wherein in the ice-releasing operation checking step, driving time for performing an initial operation of the heater can be variably adjusted.

11. The method as claimed in claim 1, wherein the specific operations checking step includes confirming normal operation of the electrical components based on reference values outputted from a control unit.

12. The method as claimed in claim 1, wherein the set values comprise at least one of a value used in an initial position checking operation, a value used to control a driving duration of a solenoid valve, a value used to control a time for completion of an ice making operation, a value used to control a temperature for completing an ice making operation and a value used to control a driving time for performing an initial operation of a heater.

13. The method as claimed in claim 1, wherein the set values comprise a value used to control a driving duration of a solenoid valve which supplies water to the ice maker.

14. The method as claimed in claim 1, wherein the set values comprise a value used to control a driving rime for performing an initial operation of a heater used to release ice from the ice maker.

15. A method of testing an ice maker for a refrigerator, comprising:

inputting a test signal for checking an operating state of the ice maker;

checking an initial position of a release means for separating ice from an ice-making container;

checking a water supply operation for supplying the ice-making container with water, wherein in the water supply checking step, a driving duration of a solenoid valve for supplying water can be variably adjusted;

checking an operation for making ice from the water supplied to the ice container; and checking an operation for releasing the ice from the ice-making container.

16. The method as claimed in claim 15, wherein in the ice-releasing operation checking step, it is confirmed that a heater for melting the ice is operational.

17. The method as claimed in claim 16, wherein in the ice-releasing operation checking step, a driving time for performing an initial operation of a heater can be variably adjusted.

18. A method of testing an ice maker for a refrigerator, comprising:

inputting a test signal for checking an operating state of the ice maker;

checking an initial position of a release means for separating ice from an ice-making container;

checking a water supply operation for supplying the ice-making container with water;

checking an operation for making ice from the water supplied to the ice-making container; and checking an operation state for releasing ice from the ice-making container, wherein during the ice-releasing operation checking step a driving time for an initial operation of a heater can be variably adjusted.

19. A method of testing an ice maker for a refrigerator, comprising:

inputting a test signal for checking an operating state of the ice maker; and checking a water supply operation for supplying water to an ice-making container, wherein during the water supply checking step, a driving duration for driving a solenoid valve that supplies water to the ice-making container can be variably adjusted.

20. A method as claimed in claim 19, further comprising an initial position checking step for checking an initial position of a rotating release mechanism for releasing ice from the ice-making container, wherein during the initial position checking step, the rotating release mechanism is rotated less than a full rotation.

21. A method of testing an ice maker for a refrigerator, comprising:

inputting a test signal for checking an operating state of the ice maker; and checking an operation state for releasing ice from the ice-making container, wherein during the ice-releasing operation checking step, a driving time for an initial operation of a heater can be variably adjusted.

22. A method as claimed in claim 21, further comprising an initial position checking step for checking an initial position of a rotating release mechanism for releasing ice from the ice-making container, wherein during the initial position checking step, the rotating release mechanism is rotated less than a full rotation.

* * * * *